US009220944B2

(12) United States Patent
Moscarello

(10) Patent No.: US 9,220,944 B2
(45) Date of Patent: Dec. 29, 2015

(54) APPARATUS FOR EXERCISE AND BALANCE TRAINING

(71) Applicant: Bruce Peter Moscarello, Arlington, VT (US)

(72) Inventor: Bruce Peter Moscarello, Arlington, VT (US)

(73) Assignee: Balance Designs, Inc., Manchester, VT (US)

( * ) Notice: Subject to any disclaimer, the term of this patent is extended or adjusted under 35 U.S.C. 154(b) by 221 days.

(21) Appl. No.: 13/765,674

(22) Filed: Feb. 12, 2013

(65) Prior Publication Data

US 2014/0228187 A1 Aug. 14, 2014

(51) Int. Cl.

| | |
|---|---|
| ***A63B 22/16*** | (2006.01) |
| ***A63B 26/00*** | (2006.01) |
| ***A63B 22/18*** | (2006.01) |
| *A63B 69/00* | (2006.01) |

(52) U.S. Cl.

CPC ..... *A63B 26/003* (2013.01); *A63B 22/18* (2013.01); *A63B 69/0093* (2013.01)

(58) Field of Classification Search

CPC .. A63B 26/003; A63B 26/00; A63B 21/1492; A63B 2208/0204; A63B 2225/09; A63B 22/16; A63B 22/18; A63B 2026/003

USPC ..... 482/51, 142, 145–148; 280/14.21–14.22, 14.26–14.28, 18; D21/412, 671, 688

See application file for complete search history.

(56) References Cited

U.S. PATENT DOCUMENTS

| | | | | | |
|---|---|---|---|---|---|
| 2,941,801 | A | * | 6/1960 | Pedersen | 482/146 |
| 2,950,120 | A | * | 8/1960 | Stewart | 482/51 |
| D202,796 | S | * | 11/1965 | Patterson | D21/688 |
| 3,262,701 | A | * | 7/1966 | Howland | 482/146 |
| 3,862,768 | A | * | 1/1975 | England | 280/205 |
| 3,895,794 | A | * | 7/1975 | England | 482/146 |
| D237,897 | S | * | 12/1975 | England | D21/688 |
| D237,989 | S | * | 12/1975 | England | D21/688 |
| 3,967,820 | A | * | 7/1976 | Harper | 482/146 |
| D276,062 | S | * | 10/1984 | Dennis | D21/688 |
| D281,260 | S | * | 11/1985 | Smith | D21/688 |
| 4,601,469 | A | * | 7/1986 | Sasser, Jr. | 482/146 |
| 4,705,272 | A | * | 11/1987 | Rupprecht | 482/146 |
| 4,966,364 | A | * | 10/1990 | Eggenberger | 482/146 |
| 5,048,823 | A | * | 9/1991 | Bean | 482/146 |
| 5,152,691 | A | | 10/1992 | Moscarello | |
| D365,610 | S | * | 12/1995 | Fraser | D21/688 |
| 5,496,248 | A | * | 3/1996 | Batscher | 482/146 |
| D375,985 | S | * | 11/1996 | Dailey et al. | D21/688 |
| D376,629 | S | * | 12/1996 | Mounts et al. | D21/412 |
| 5,584,787 | A | * | 12/1996 | Guidry | 482/146 |
| 5,643,164 | A | * | 7/1997 | Teff | 482/146 |
| 5,647,830 | A | * | 7/1997 | Togao | 482/146 |

(Continued)

FOREIGN PATENT DOCUMENTS

EP 1790395 * 11/2005

*Primary Examiner* — Loan H Thanh
*Assistant Examiner* — Andrew S Lo
(74) *Attorney, Agent, or Firm* — Thomas G. Ference

(57) ABSTRACT

The present application is directed to a balance board upon which a user may exercise, conduct balance training and do tricks. The balance board comprises a body member with at least two separate balancing surfaces extending from the lower surface with a discontinuity between each separate balancing surface. A first balancing surface is provided by a hub member and a second balancing surface is provided by one or more nub members. These balancing surfaces facilitate the capability of a variety of new balance and strengthening exercises.

31 Claims, 16 Drawing Sheets

(56) References Cited

U.S. PATENT DOCUMENTS

| | | | | |
|---|---|---|---|---|
| 5,730,690 | A * | 3/1998 | Guidry | 482/146 |
| 5,795,277 | A * | 8/1998 | Bruntmyer | 482/146 |
| 5,897,474 | A * | 4/1999 | Romero | 482/146 |
| D418,563 | S * | 1/2000 | Hwang | D21/688 |
| 6,017,297 | A * | 1/2000 | Collins | 482/146 |
| 6,019,712 | A * | 2/2000 | Duncan | 482/110 |
| 6,352,268 | B1 * | 3/2002 | Peart | 280/14.21 |
| 6,616,583 | B1 * | 9/2003 | Stack | 482/146 |
| 6,666,797 | B1 * | 12/2003 | Martin | 482/51 |
| 6,705,977 | B1 * | 3/2004 | Ziak | 482/146 |
| 6,916,276 | B1 * | 7/2005 | Robinson | 482/51 |
| 7,137,938 | B2 * | 11/2006 | Gottlieb | 482/146 |
| D564,604 | S * | 3/2008 | Mikail | D21/688 |
| 7,488,177 | B2 * | 2/2009 | Pearson | 434/247 |
| 7,632,218 | B2 * | 12/2009 | Sannes et al. | 482/51 |
| 7,686,751 | B2 * | 3/2010 | Carlson et al. | 482/146 |
| 7,695,407 | B2 | 4/2010 | Miller et al. | |
| 7,823,892 | B2 * | 11/2010 | Olson et al. | 280/14.22 |
| 7,942,797 | B1 * | 5/2011 | Canton et al. | 482/146 |
| 8,371,604 | B1 * | 2/2013 | Soucy | 280/609 |
| 8,734,308 | B1 * | 5/2014 | Joslin | 482/146 |
| 2001/0019198 | A1 * | 9/2001 | Wolf | 280/609 |
| 2002/0008360 | A1 * | 1/2002 | Ellington | 280/14.21 |
| 2002/0070515 | A1 * | 6/2002 | Barbieri et al. | 280/14.21 |
| 2002/0077222 | A1 * | 6/2002 | Daly | 482/77 |
| 2002/0121752 | A1 * | 9/2002 | Gille et al. | 280/18 |
| 2003/0160404 | A1 * | 8/2003 | Bobrowicz | 280/14.21 |
| 2004/0014571 | A1 * | 1/2004 | Haynes | 482/142 |
| 2004/0033864 | A1 * | 2/2004 | Elbaz et al. | 482/51 |
| 2004/0171463 | A1 * | 9/2004 | Rozycki et al. | 482/51 |
| 2005/0017463 | A1 * | 1/2005 | Kane | 280/14.22 |
| 2005/0101441 | A1 * | 5/2005 | Rosborough et al. | 482/51 |
| 2006/0082089 | A1 * | 4/2006 | Rejtano | 280/87.042 |
| 2006/0217250 | A1 * | 9/2006 | Pearson | 482/146 |
| 2006/0270536 | A1 * | 11/2006 | Tukada | 482/146 |
| 2006/0287173 | A1 * | 12/2006 | Guadagno | 482/142 |
| 2007/0027010 | A1 * | 2/2007 | Tsai | 482/146 |
| 2007/0149365 | A1 * | 6/2007 | Carlson | 482/79 |
| 2007/0149374 | A1 * | 6/2007 | Carlson | 482/146 |
| 2008/0096730 | A1 * | 4/2008 | Miller et al. | 482/51 |
| 2009/0105057 | A1 * | 4/2009 | Carlson et al. | 482/146 |
| 2009/0197748 | A1 * | 8/2009 | Smith | 482/146 |
| 2010/0087301 | A1 * | 4/2010 | Juncker | 482/146 |
| 2010/0304941 | A1 * | 12/2010 | Ota | 482/146 |
| 2011/0143896 | A1 * | 6/2011 | Senegal | 482/139 |
| 2012/0065040 | A1 * | 3/2012 | Smith | 482/146 |
| 2013/0053228 | A1 * | 2/2013 | Winegar | 482/146 |
| 2013/0310235 | A1 * | 11/2013 | Carr | 482/145 |

* cited by examiner

APPARATUS FOR EXERCISE AND BALANCE TRAINING

RELATED APPLICATIONS

This application claims the benefit of priority of U.S. Provisional Patent Application No. 61/633,542, filed Feb. 14, 2012 entitled "Balance Training Device", which is incorporated herein by reference.

FIELD

This patent application generally relates to a balance board for exercise and balance training. More specifically, it relates to a balance board having a body member with a hub member and at least one nub member extending from the body member's lower surface. A user standing on the board manipulates the position of the hub and nub members relative to a contacting surface in order to perform a variety of exercises that improve the user's balance and physical strength.

BACKGROUND

Certain exercise devices, generally designated "balance boards", have been available for training of persons for the purpose of improving balance in a standing position. Such boards are generally designed to permit tilting in a single vertical plane about a centered fulcrum, typically the fulcrum is a cylindrical roller placed below the board. Other balance boards include upwardly concave boards having a front portion end that is more distally located from the balance point than is a back portion end so as to provide for an off-center balance position. All of these balance boards work on the premise of a single balance point and in general have a limited range of motion through which the person may perform balancing exercises.

Balance boards are popular primarily with athletes who specialize in sports such as snowboarding, skateboarding and surfing which require exceptional balance control, but these boards can also be used to help athletes in other sports where leg and mid-body strength are important. Furthermore, exercise specialist may incorporate balance boards into their exercise and rehabilitation routines.

Prior art balance boards have primarily focused on a single balance point on which a limited variety of balance exercises can be performed. The current application puts forth a novel structure that expands the versatility of a balance board by providing a new structure that has multiple balance points which facilitate the capability of a variety of new balance and strengthening exercises.

SUMMARY

One aspect of the present patent application is directed to an apparatus for a user to balance upon on a contacting surface. The apparatus comprises a body member bound by an upper surface, a lower surface and a circumscribing edge surface. The apparatus has a hub member extending from the lower surface. The hub member has an outer hub surface and a hub apex. The apparatus has at least one nub member extending from the lower surface. The at least one nub member is located between the hub member and the circumscribing edge surface. The outer nub surface is raised relative to the ground surface when the body member is balanced on the hub apex.

Another aspect of the present patent application is directed to an apparatus for a user to balance upon on a contacting surface. The apparatus comprises a body member bound by an upper surface, a lower surface and a circumscribing edge surface. The body member has a first vertical plane of symmetry. The lower surface defines a first lower surface radius of curvature within the first vertical plane of symmetry. The first lower surface radius of curvature is concave and curves towards the upper surface. The apparatus includes a hub member extending from the lower surface. The apparatus has at least one nub member extending from the lower surface. Each nub member is located between the hub member and the circumscribing edge surface.

Another aspect of the present patent application is directed to an apparatus for a user to balance upon on a contacting surface. The apparatus has a body member bound by an upper surface, lower surface and a circumscribing edge surface. The body member has a hub apex. The lower surface defines a first lower contact radius of curvature in a first vertical plane. The first lower contact radius of curvature is concave and curves towards the upper surface. The lower contact radius of curvature has a first discontinuity wherein the lower surface is depressed towards the upper surface between the hub apex and the circumscribing edge surface.

BRIEF DESCRIPTION OF DRAWINGS

The foregoing and other aspects and advantages will be apparent from the following detailed description, as illustrated in the accompanying drawings, in which:

FIG. 7*a* is a perspective view of an embodiment of the apparatus in FIG. 1*a* having only one hub member and one nub member, both the nub and hub members offset relative to the center of the body member;

DETAILED DESCRIPTION

Figure 1A:
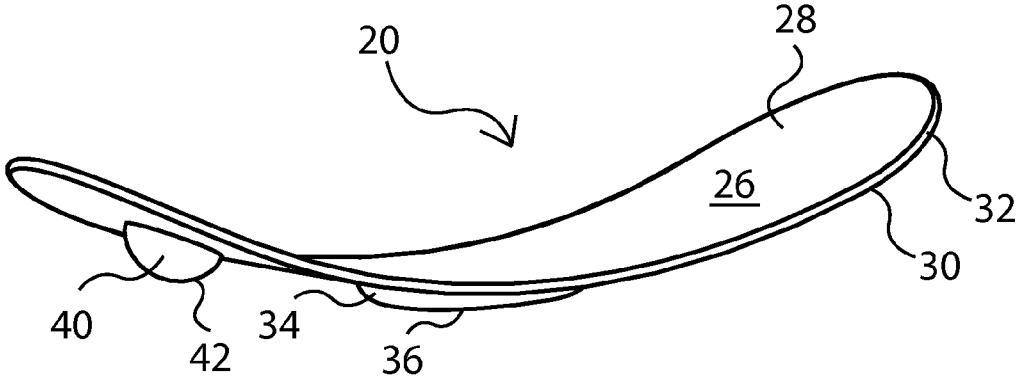
FIG. 1*a* is a perspective view of one embodiment of a balance apparatus according to the present patent application.
Figure 1B:
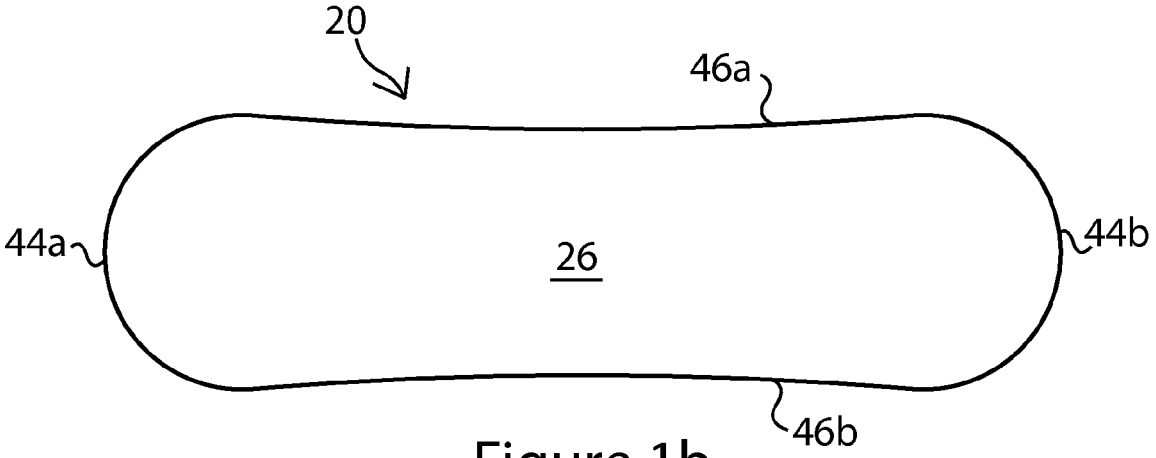
FIG. 1*b* is a top view of the apparatus in FIG. 1*a;*
Figure 1C:
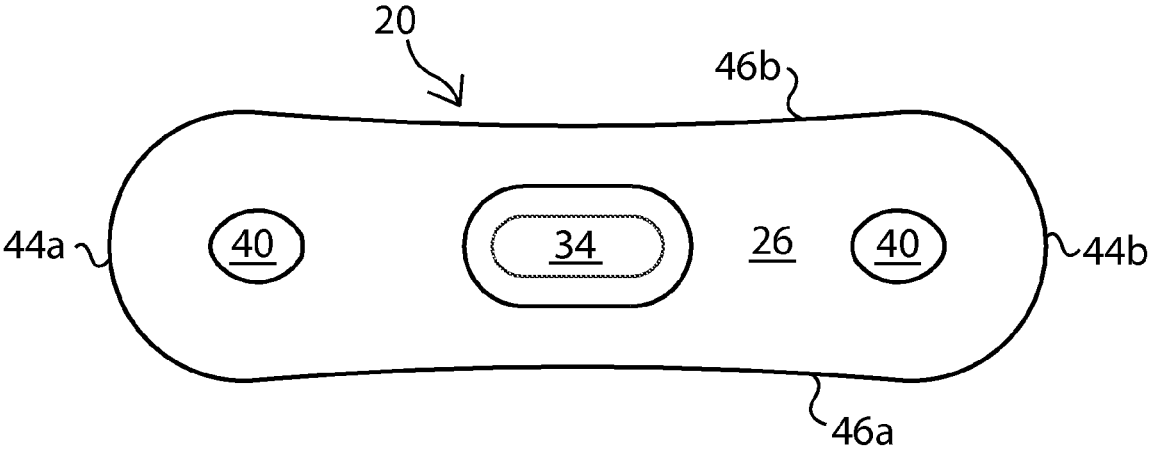
FIG. 1*c* is as bottom view of the apparatus in FIG. 1*a;*
Figure 1D:
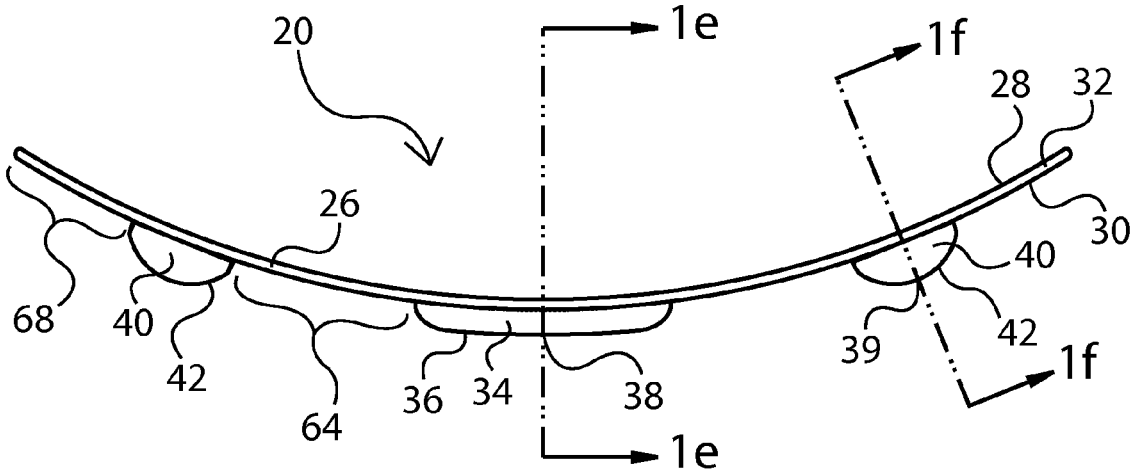
FIG. 1*d* is a side view of the apparatus in FIG. 1*a;*
Figure 1E:
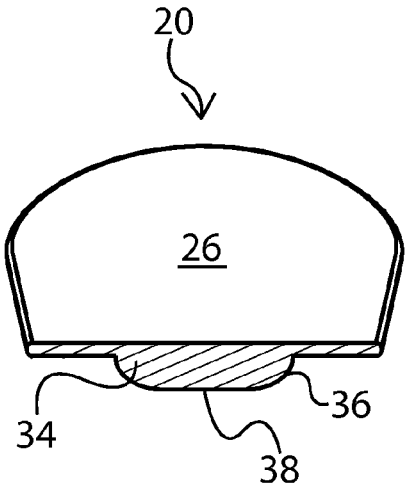
FIG. 1*e* is a sectional view of the apparatus in FIG. 1*a* along line 1*e*-1*e* of FIG. 1*d;*
Figure 1F:
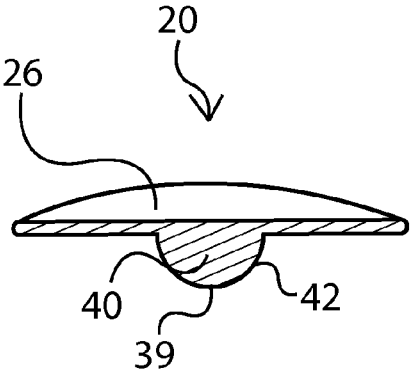
FIG. 1*f* is a sectional view of the apparatus in FIG. 1*a* along line 1*f*-1*f* of FIG. 1*d;*

The present invention is illustrated in FIGS. 1*a*-9*f*. Apparatus 20 (a.k.a. balance apparatus, balance board) is engineered for a user 22 to balance upon on a contacting surface 24. Apparatus 20 comprises a body member 26 bound by an upper surface 28, a lower surface 30 and a circumscribing edge surface 32. Body member 26 includes a hub member 34 (a.k.a. hub) extending from lower surface 30. Hub member 34 has an outer hub surface 36 and a hub apex 38. Body member 26 also includes at least one nub member 40 (a.k.a. nub) extending from lower surface 30. Each nub member 40 has an outer nub surface 42 and a nub apex 39. Each nub member 40 is located between hub member 34 and circumscribing edge surface 32. Outer nub surface 42 is raised relative to contacting surface 24 when body member 26 is balanced on hub apex 38.

Body member 26 may be fabricated from a wide variety of materials including, but not limited to laminated wood, injection molded plastic and carbon fibers. Although apparatus 20 is preferably substantially rigid, a controlled degree of resiliency is contemplated for specialized exercise effects. Body member 26 may be flat, but is preferably concave up curving away from contacting surface 24. Body member 26 may be symmetric in all directions thereby being circular or a bowl-shaped, FIG. 8*a*-*e*. Body member 26 may also be non-symmetrical in one or more directions, FIG. 7*a*-7*f*. Body member 26 may have two separate planes of symmetry a first vertical plane of symmetry and a second vertical plane of symmetry perpendicular to the first plane of symmetry. When body member has an elongated direction along the first vertical plane of symmetry, two opposing ends (44*a*, 44*b*) and two opposing lateral edges (46*a*, 46*b*) are defined. The first vertical plane of symmetry bisects body member 26 between the two opposing lateral edges (46*a*, 46*b*). The second vertical plane of symmetry bisects body member 26 along the lateral direction between the two opposing ends (44*a*, 44*b*), a.k.a. nose and tail respectively. FIGS. 1*a*-7*f* and 9*a*-*f* show apparatus 20 with elongated or oval-shaped body members 26. In these elongated examples opposing lateral edges (46*a*, 46*b*) are turned up away from the contacting surface. Circumscribing edge surface 32 may be one continuous surface or the circumscribing edge surface may have a plurality of different angular orientations, e.g. a faceted edge surface. Upper surface 28 and lower surface 30 may be complimentary shaped surfaces to provide a uniform thickness to body member 26, FIGS. 1*a*-5*f* and 7*a*-9*f*, or the upper and lower surface may take on different shapes providing for a body member with different thicknesses, FIGS. 6*a*-*f*. Apparatus 20 will generally have an elongated length that is roughly 12-to-40 inches providing for a standing area for user 20 and a perpendicular lateral width that is 2-to-12 inches to accommodate the length of the user's feet.

Figure 2A:
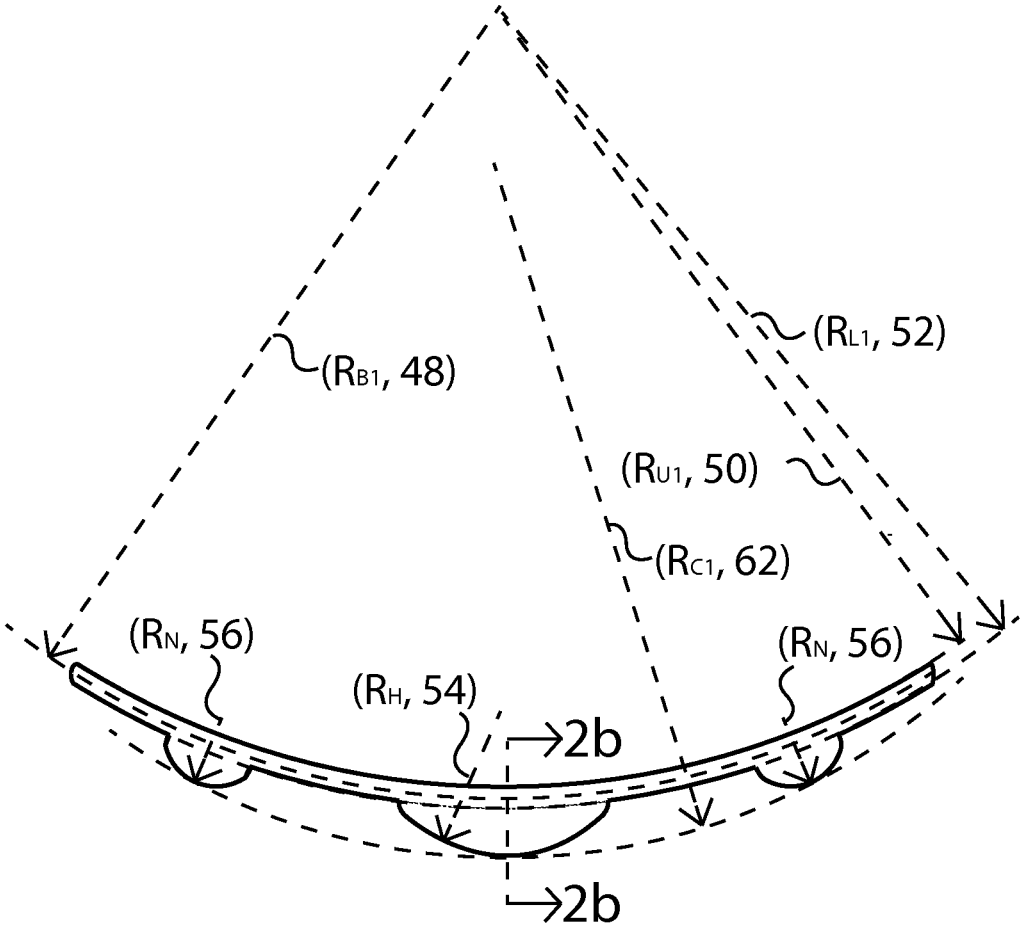
FIG. 2*a* is a schematic view depicting various radii of curvature for the balancing apparatus of FIG. 1*a;*
Figure 2B:
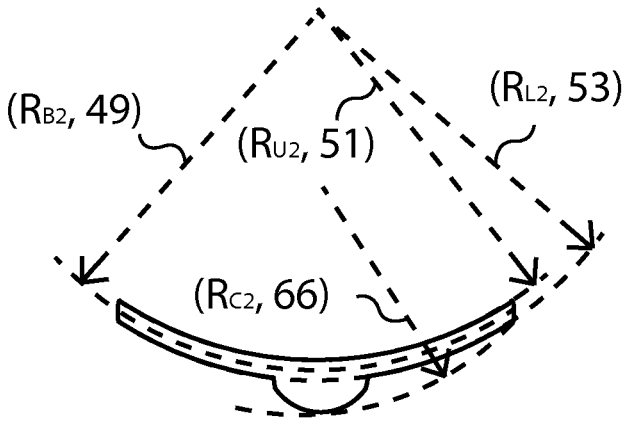
FIG. 2*b* is a schematic view depicting various radii of curvature in a direction perpendicular to those shown in FIG. 2*a* and along line 2*b*-2*b* for the balancing apparatus of FIG. 1*a;*

FIGS. 2*a* and 2*b* schematically illustrate that body member 26 may have a first body radius of curvature ($R_{B1}$, 48) within the first vertical plane of symmetry, the first body radius of curvature being concave and curves away from hub member 34. Body member 26 may have a second body radius of curvature ($R_{B2}$, 49) within the second vertical plane of symmetry, the second body radius of curvature being concave and curves away from hub member 34. Apparatus 20 in FIGS. 1*a*-*e* illustrates an apparatus with a first body radius of curvature along the elongated direction, but no second body radius of curvature in the transverse/lateral direction (i.e., the second radius of curvature is infinite). Body member 26 is flat in this lateral direction. Apparatus 20 of FIGS. 2*a*, 2*b* and 4*a*-*f* illustrates the apparatus with both a first body radius of curvature and a second radius body of curvature. The first body radius of curvature is generally in a range from infinity to 20-inches, but preferably in a range of 35-to-20 inches. The second body radius of curvature is generally in a range from infinity to 5-inches, but preferably in a range of 15-to-5 inches. When upper surface 28 and lower surface 30 are complimentary shaped, those surfaces will have the same radius of curvature as body member 26 and define both a first and second upper surface radius of curvature ($R_{U1}$, 50), ($R_{U2}$, 51) and a first and second lower surface radius of curvature ($R_{L1}$, 52), ($R_{L2}$, 53) that are respectively the same magnitude as the first and second body radius of curvature (49, 50). However, when upper surface 28 and lower surface are not complimentary shaped, first and second upper surface radius of curvature (50, 51) may be different from first and second lower surface radius of curvature (52, 53), FIGS. 6*a*-*f*.

Hub member 34, which extends from lower surface 30, may be made integral with body member 26 as a single piece of material or the hub member may be a separate piece that is fastened to the lower surface. Generally hub member 34 extends from ⅛-inch to 6-inches from lower surface 30. In some embodiments hub member 34 may be movably adjustable in any direction along lower surface 30. Hub member 34 has an outer hub surface 36 that defines a hub radius of curvature ($R_H$, 54). Hub radius of curvature 54 may vary in magnitude and in contour over outer hub surface 36 depending upon the sought exercise maneuvers. Outer hub surface 36 may be symmetrical or non-symmetrical (FIG. 7*g*) and defines a first balancing surface for balancing upon contacting surface 24. The extent of the first balancing surface is that area of outer hub surface 36 for which apparatus 20 balances on hub member 34 until the apparatus touches nub member 40. Hub member 34 has a hub apex 38, the single point or line that extends the furthest from lower surface 30. Hub member 34 may be centrally located to or offset from the center of body member 26. Hub member 34 may have an outer hub surface 36 with varied frictional properties for interaction with contacting surface 24. The primary function of hub member 34 is to serve as a fulcrum about which apparatus 20 can be pivoted. Hub member 34 also allows for horizontal spinning/rotational motion around hub apex 38 of apparatus 20.

Each nub member 40, which extends from lower surface 30, may be made integral with body member 26 as a single piece of material or each nub member may be a separate piece that is fastened to the lower surface. Generally nub member 40 extends from ⅛-inch to 4-inches from lower surface 30. Each nub member 40 may also be movably adjustable in any direction along lower surface 30. Each nub member 40 has an outer nub surface 42 that defines a nub radius of curvature ($R_N$, 56). Nub radius of curvature 56 may vary in magnitude over outer hub surface 42. Outer nub surface 42 may be symmetrical or non-symmetrical and defines a second balancing surface for balancing upon contacting surface 24. The extent of the second balancing surface is that area of outer nub surface 42 for which apparatus 20 balances on nub member 40 until the apparatus touches either hub member 34 or circumscribing edge surface 32. Nub member 40 has a nub apex 39, the point or line that extends the furthest from lower surface 30. Nub members 40 are located between huh member 34 and circumscribing edge surface 32. Nub members 40 may have an outer nub surface 42 with varied frictional properties for interaction with contacting surface 24. The primary function of nub member 40 is to serve as a stop for balancing motion around hub member 34. Nub member 40 also acts as a secondary fulcrum about which apparatus 20 can be pivoted. Nub member 40 also allows for horizontal spinning/rotational motion around nub apex 39 of apparatus 20. Different nub members may have different sizes and different nub radii of curvature on the same apparatus 20. The magnitude of hub radius of curvature 54 and nub radius of curvature 56 may be the same or different.

For apparatus 20, hub member 34 provides a first balancing surface and each nub member 40 provides a second balancing surface. Together the combination of a hub member 34 and nub member 40 define a first lower contact radius of curvature ($R_{C1}$, 62) in a first vertical plane, FIGS. 2*a* and 2*b*. First lower contact radius of curvature 62 is concave and curves towards upper surface 28. In order for apparatus 20 to facilitate certain balancing exercises, a first discontinuity 64 must exist in this first lower contact radius of curvature 62 by having a region of lower surface 30 that is depressed away from the contact radius of curvature 62 between hub apex 38 and circumscribing edge surface 32. First discontinuity 64 thereby defines the location of hub member 34 and nub member 40 and creates a region where no balancing surface exists between the first balancing surface of the hub member and the second balancing surface of the nub member. This first discontinuity 64 forces a user to balance on either outer hub surface 36, outer nub surface 42 or both. First discontinuity 64 creates a region of "increased difficulty of balance" between balancing on hub member 34 and nub member 40. This structure thereby facilitates unique exercises that cannot currently be performed on other balance board structures having just one balancing surface. Apparatus 20 may also include a second lower contact radius of curvature ($R_{C2}$, 66) perpendicular to first contact radius of curvature 62. Second lower contact radius of curvature 66 is concave and curves towards upper surface 28. This second lower contact radius of curvature allows balance to be practiced by the user in directions perpendicular to the first lower contact radius of curvature and all directions in between these two radii of curvature to provide for 360-degree balancing.

Numerous balancing exercises and tricks may be performed on apparatus 20 based on the novel structure of two balancing surfaces created by outer hub surface 36 of hub member 34, outer nub surface 42 of nub member 40, and the first discontinuity 64 there between. One exercise is to practice balancing on hub apex 38, FIG. 3*a*. Here user 22 stands with both feet on top surface 28 and rocks back and forth on outer hub surface 36 trying to keep nub members 40 from touching contacting surface 24 and thereby produces a see-saw effect. User 22 may also try to add rotational movements and spin on hub member 34. The exact radius of curvature or change in radius of curvature of outer hub surface 36 in combination with first discontinuity 64 determines the level of difficulty of balancing. A smaller hub radius of curvature 54 makes it more difficult to balance, while a large hub radius of curvature makes it easier for the user to balance. First discontinuity 64 provides for the range of movement and nub members 40 provide stopping points for balancing motion. Having apparatus 20 with removable hub members 34 and nub members 40 allows the user to customize the apparatus for both level of difficulty and range of motion for balance. User 22 may also balance on outer nub surface 42 for performing off-centered, edge balancing exercises. Different radii of curvature within the same hub member 34 or same nub member 40 can change the difficulty in balance in different directions around each member. For example, an oval shape of outer hub surface 36 allows user 22 to perform toe and heal rocking motion as well as nose and tail rocking motion, the two rocking motions having different rockability or difficulty because of the differing radius of curvature between the two directions.

Figure 3A:
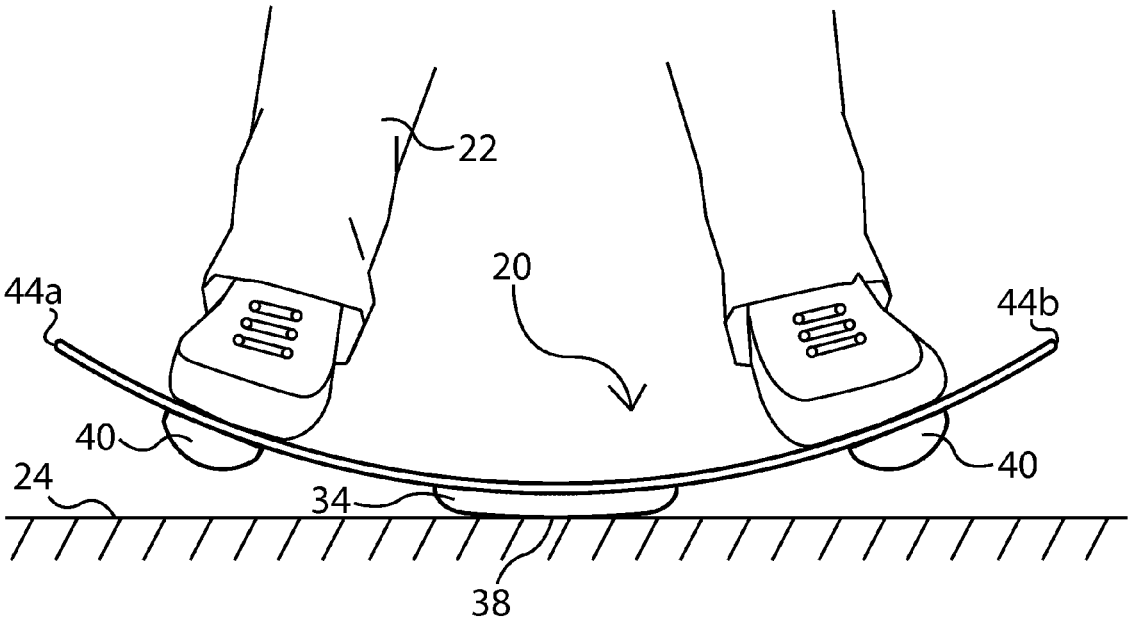
FIG. 3*a* is a side view of the apparatus in FIG. 1*a* with a user balanced upon the apparatus in a first position for an exercise routine.
Figure 3B:
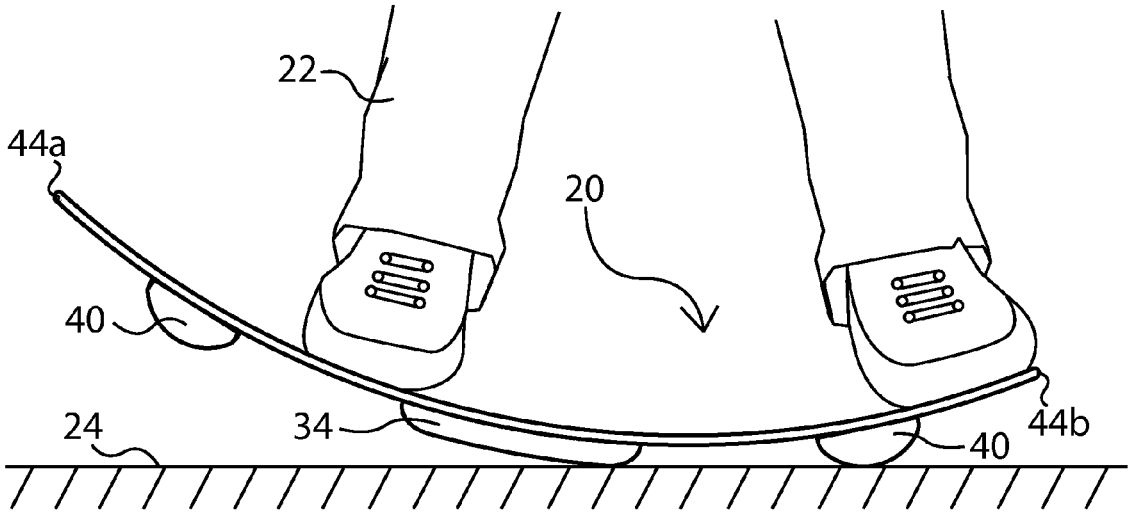
FIG. 3*b* is a side view of the apparatus in FIG. 1*a* with a user balanced upon the apparatus in a second position for an exercise routine.
Figure 3C:
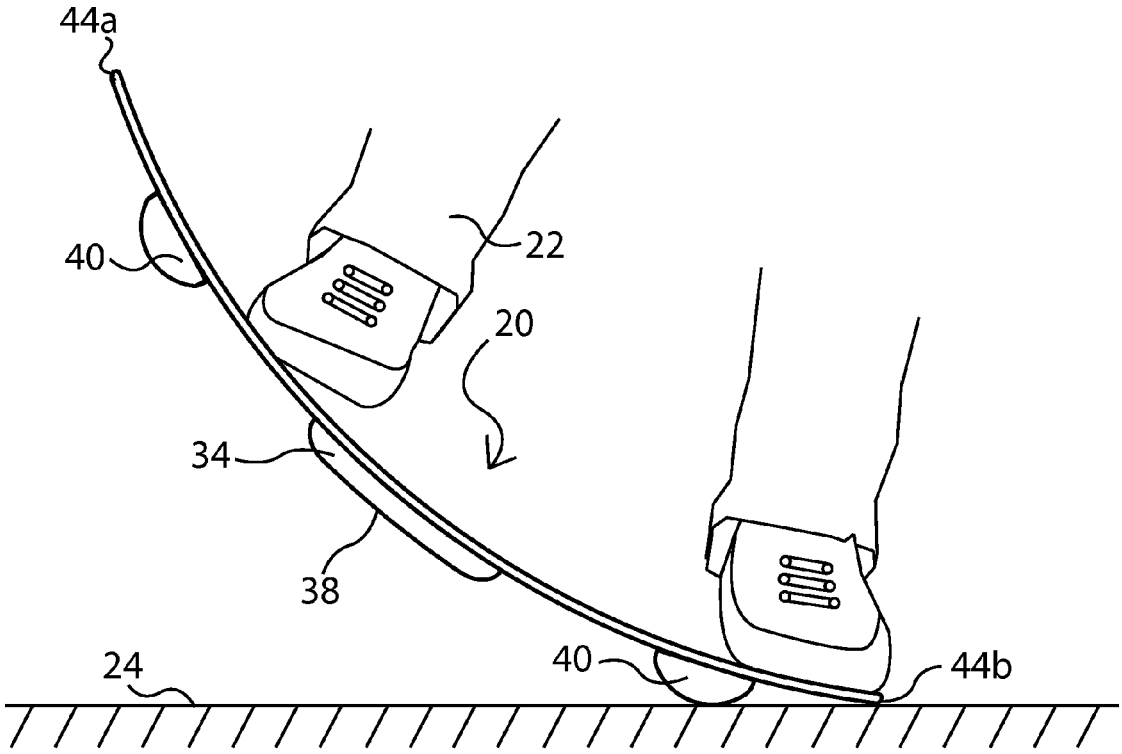
FIG. 3*c* is a side view of the apparatus in FIG. 1*a* with a user balanced upon the apparatus in a third position for an exercise routine.
Figure 3D:
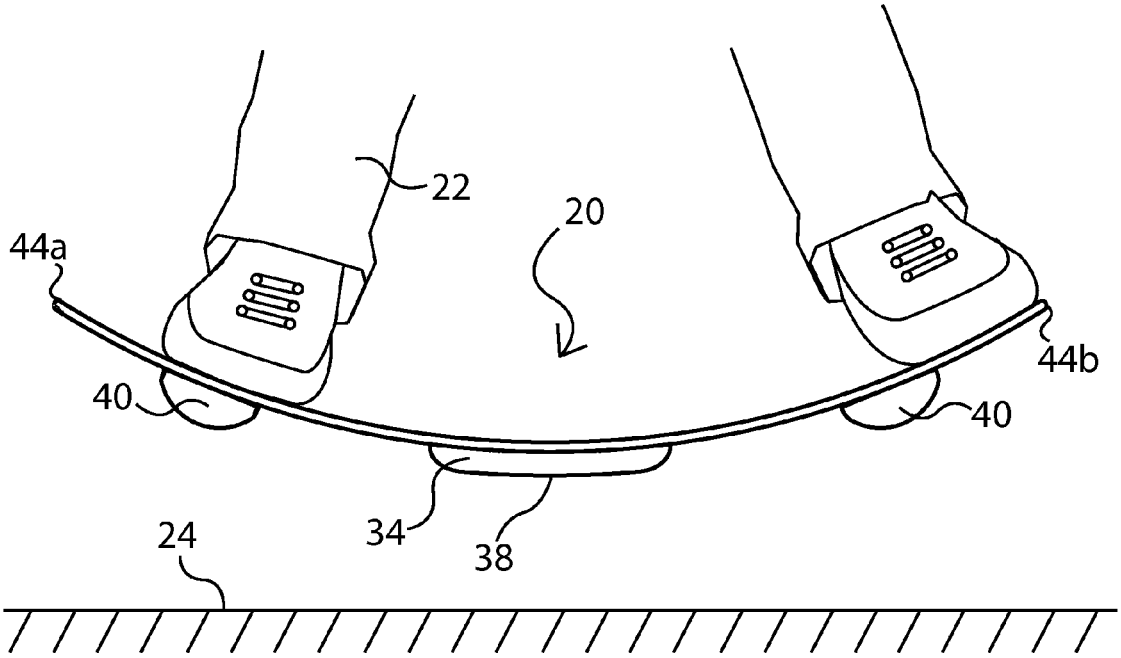
FIG. 3*d* is a side view of the apparatus in FIG. 1*a* with a user balanced upon the apparatus in a fourth position for an exercise routine.
Figure 4A:
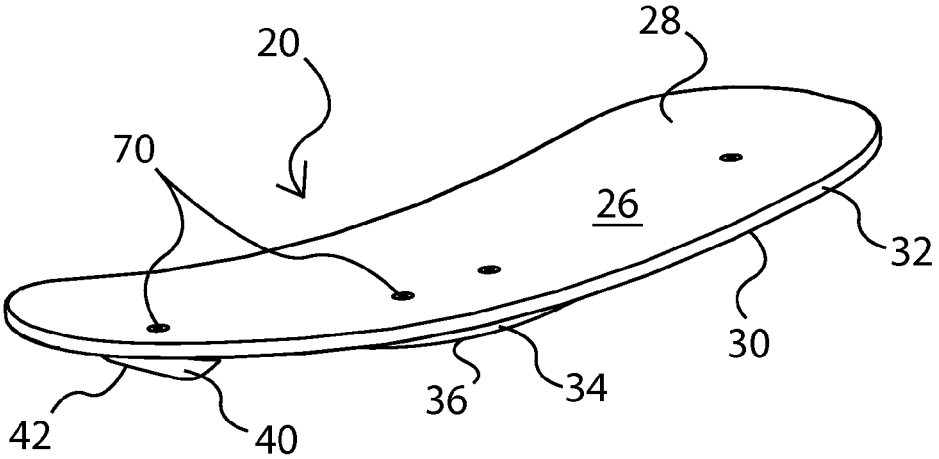
FIG. 4*a* is a perspective view of an embodiment of the apparatus in FIG. 1*a* having removable hub and nub members.
Figure 4B:
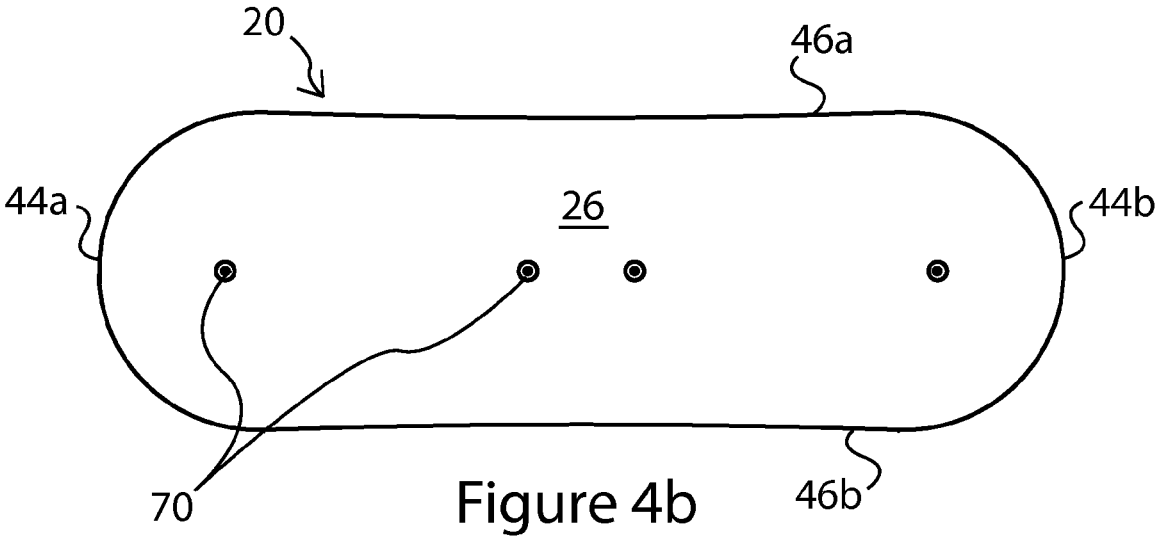
FIG. 4*b* is a top view of the apparatus in FIG. 4*a;*
Figure 4C:
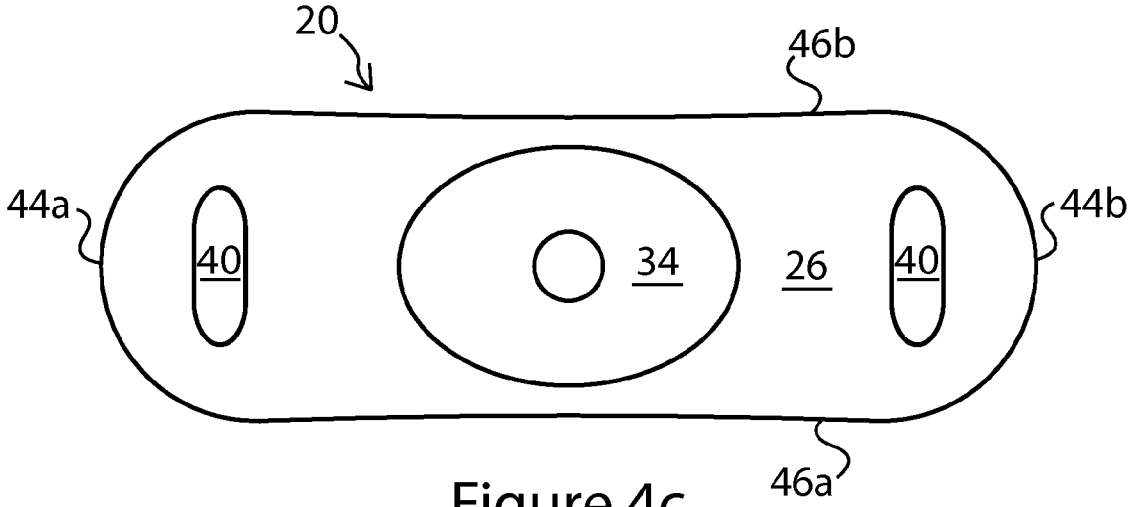
FIG. 4*c* is a bottom view of the apparatus in FIG. 4*a;*
Figure 4D:
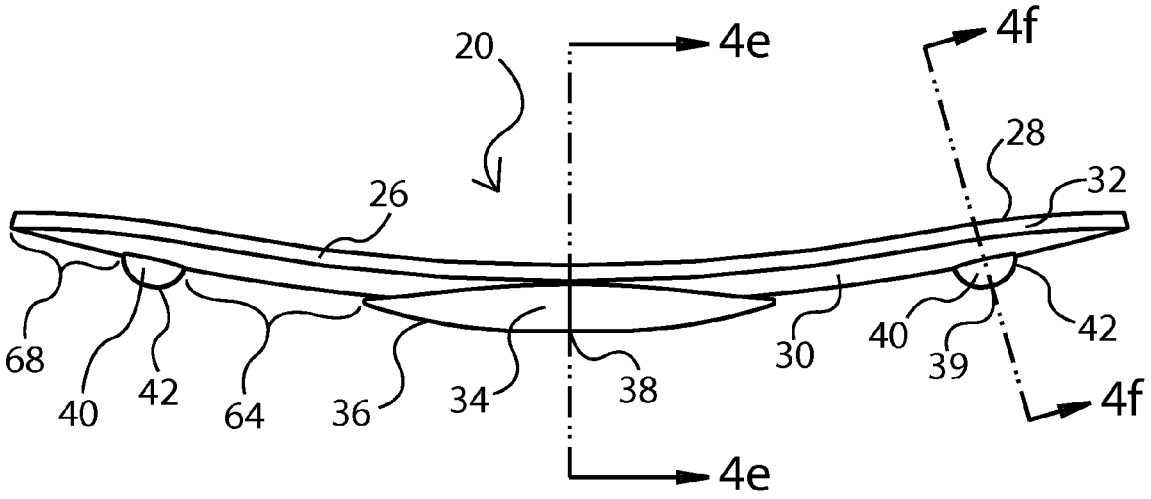
FIG. 4*d* is a side view of the apparatus in FIG. 4*a;*
Figure 4E:
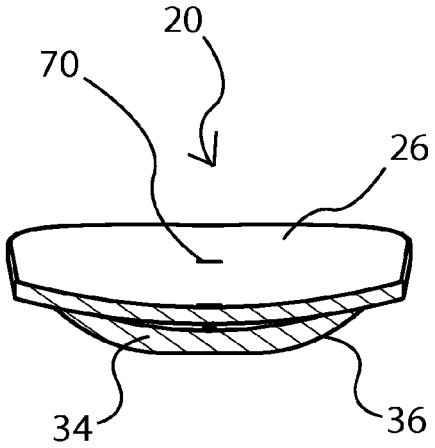
FIG. 4*e* is a sectional view of the apparatus in FIG. 4*a* along line 4*e*-4*e* of FIG. 4*d;*
Figure 4F:
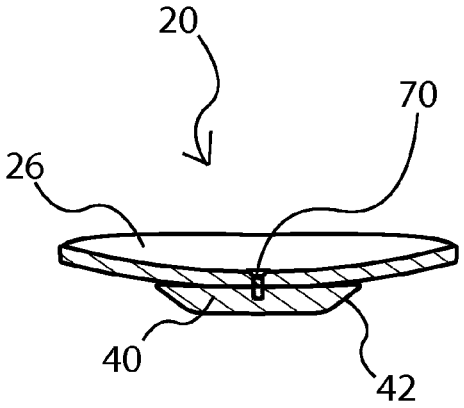
FIG. 4*f* is a sectional view of the apparatus in FIG. 4*a* along line 4*f*-4*f* of FIG. 4*d;*

Although many of the tricks performed on apparatus 20 involve the first discontinuity between the hub and nub, a special "ollie effect" illustrated in FIGS. 3*a-d*, is caused by an additional second discontinuity 68 between nub member 40 and circumscribing edge 32. Basically to ollie the user begins by distributing his or her weight evenly so as to be balanced on hub member 34, FIG. 3*a*. The user then moves their feet and weight to be balanced on both hub member 34 and nub member 40, FIG. 3*b*. Once balanced, user 22 then applies quick and forceful direct pressure with the ball of their back foot onto tail 44*b* of the balance board 20 which allows the board to initially rock up off hub member 34, solely yet momentarily, onto nub member 40 until the entire weight quickly transfers to the tail of the board as the tail makes contact with the contacting surface 24, FIG. 3*c* it is this second discontinuity 66 between nub member 40 and the tail of apparatus 20 that allows for the initial upward motion that in turn allows for the entire board to rise off the ground. FIG. 3*d*. How high user 22 can ollie apparatus 20 is dependent on other factors such as timing, hand position, foot location, pressure, body position, etc.

Numerous other exercises, maneuvers and tricks can be accomplished with apparatus 20. By critically selecting modifications of the body member, hub member, nub member, first discontinuity and second discontinuity; variations in the speed, amplitude and complexity of such maneuvers can be achieved.

Variations of the above described hub member 34 and nub member 40 structures and how these elements work together with first discontinuity 64 and second discontinuity 68 are illustrated in the following example embodiments. For example, apparatus 20 of FIGS. 1*a-f* shows one embodiment where body member 26 has a first body radius of curvature 48 in the elongated direction, but is flat in the lateral direction. The flatness in the lateral direction helps match the flatness of the user's shoes. However, this board could also have a second body radius of curvature in the lateral direction. Apparatus 20 has a hub member 34 and two nub members 40. Hub member 34 is elongated in the elongated direction of the apparatus. Nub members 40 are symmetrically placed around hub member 34. In this embodiment hub member 34 and nub members 40 are integrally fastened to extend from lower surface 30. The shapes of hub member 34 and nub member 40 can vary and are not limited to the shapes shown.

Figure 5A:
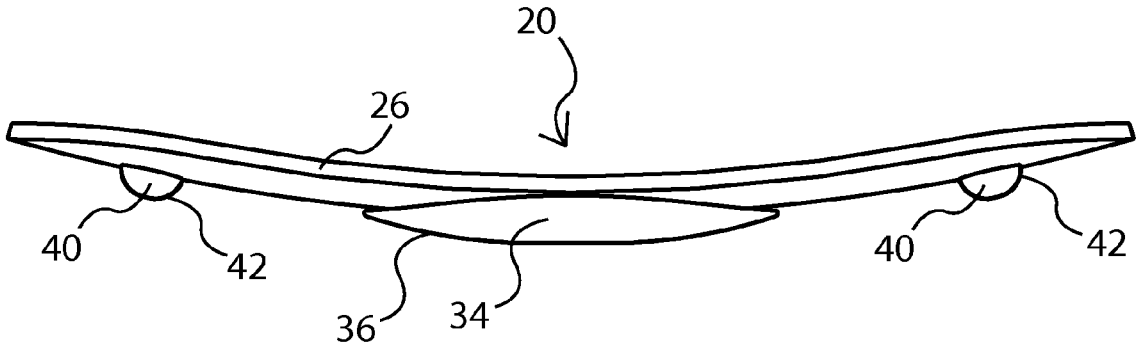
FIG. 5*a* is a side view of the apparatus in 4*a* with the hub member and two nub members fastened to the body member.
Figure 5B:
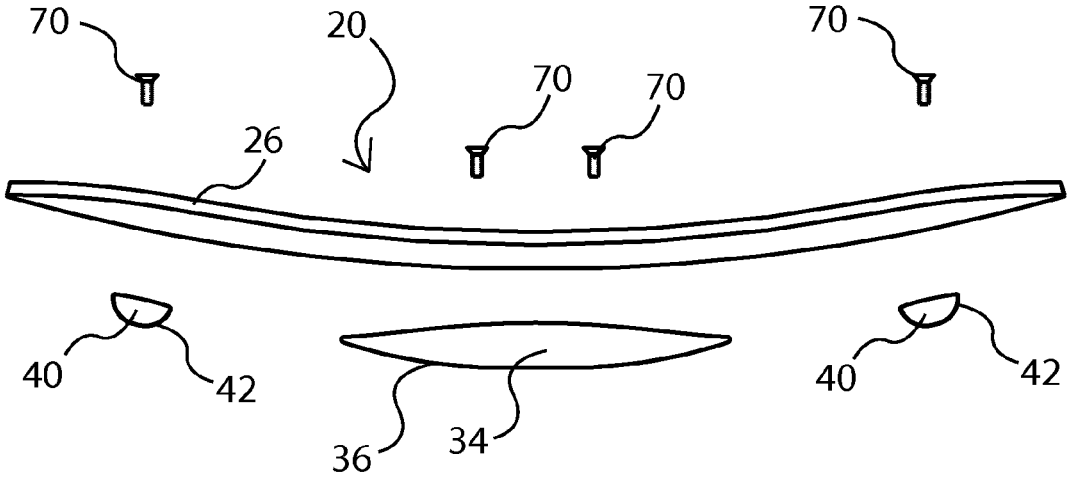
FIG. 5*b* is an exploded, side view of the apparatus in 5*a;*
Figure 5C:
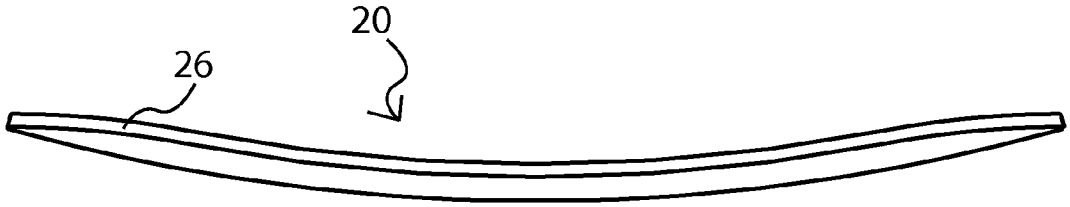
FIG. 5*c* is a side view of the apparatus in 5*a* with the hub member and two nub members removed.
Figure 6A:
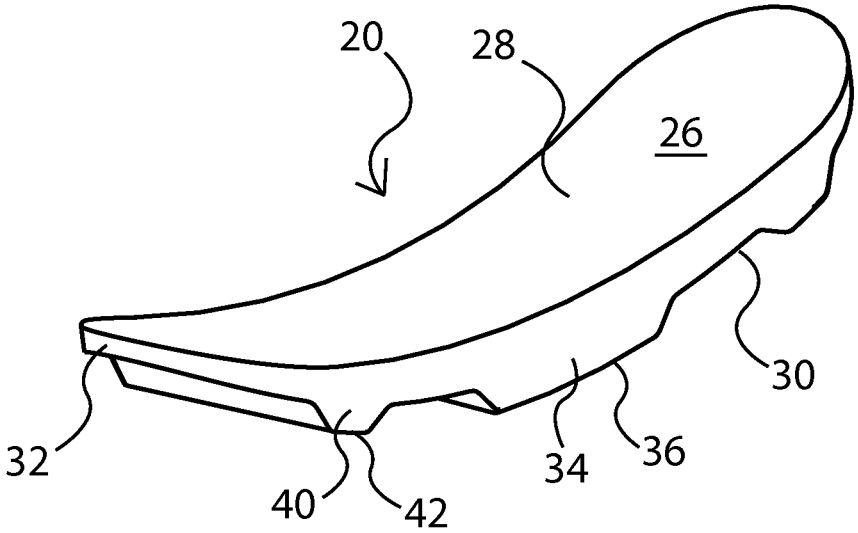
FIG. 6*a* is a perspective view of an embodiment of the apparatus in FIG. 1*a* having the hub and nub members formed by a first discontinuity in the lower surface.
Figure 6B:
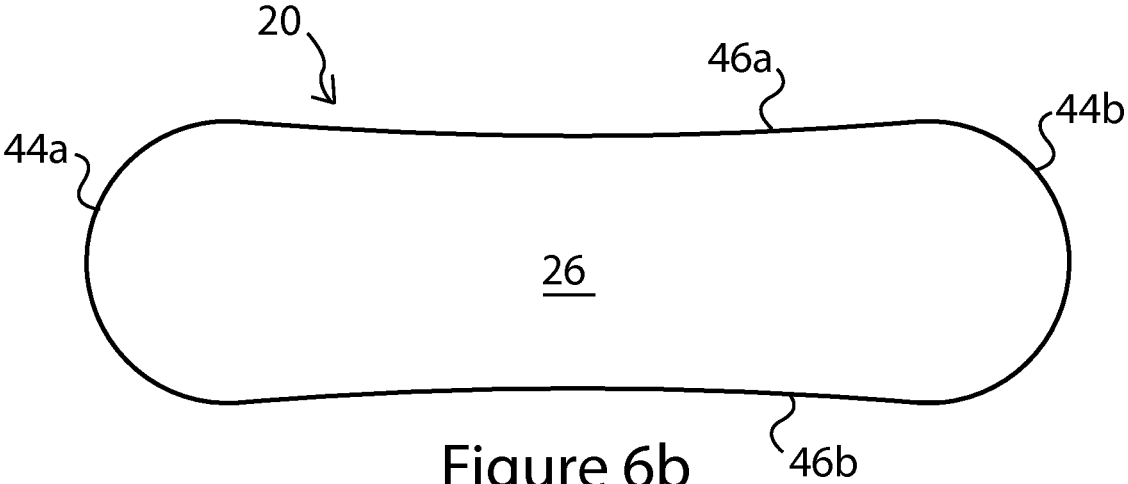
FIG. 6*b* is a top view of the apparatus in FIG. 6*a;*
Figure 6C:
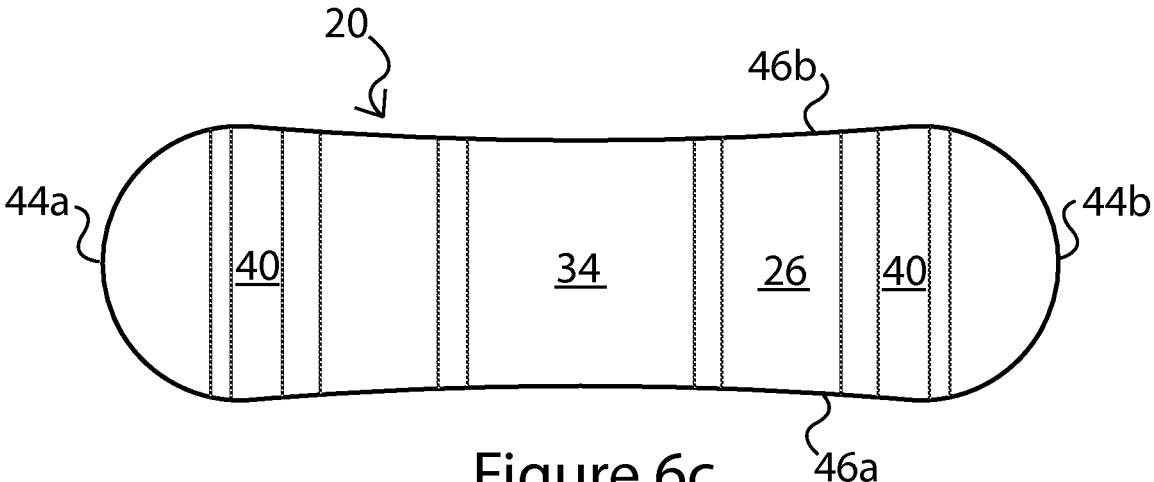
FIG. 6*c* is a bottom view of the apparatus in FIG. 6*a;*
Figure 6D:
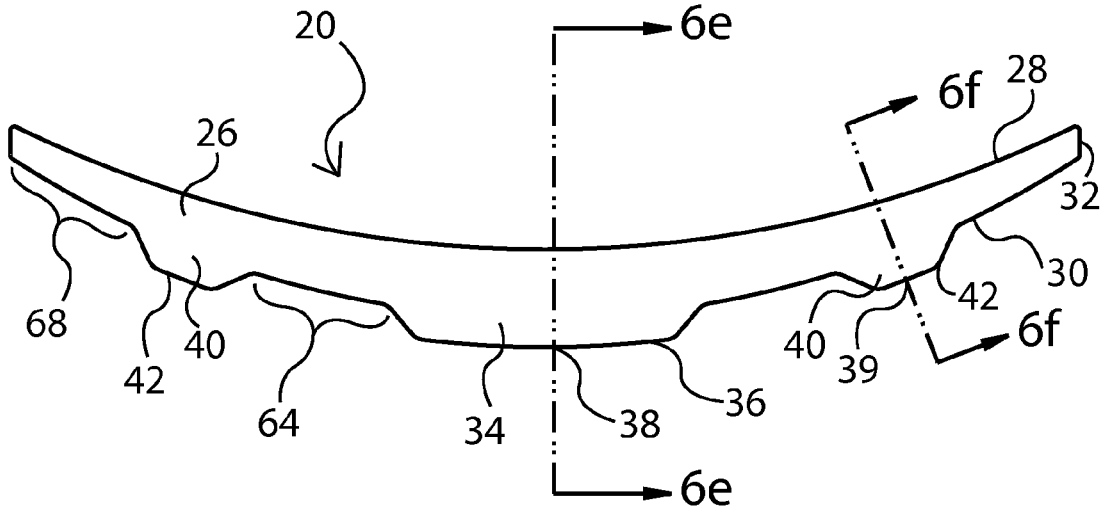
FIG. 6*d* is a side view of the apparatus in FIG. 6*a;*
Figure 6E:
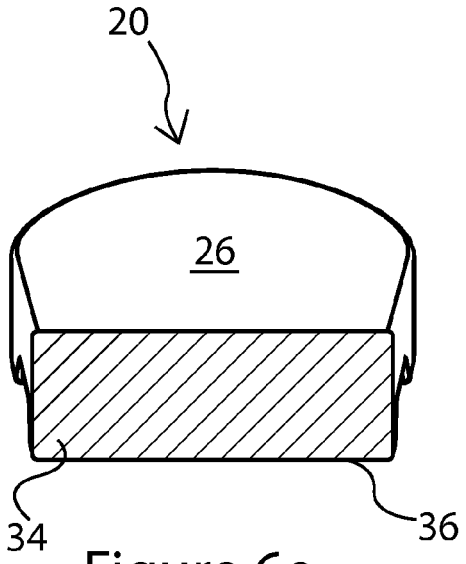
FIG. 6*e* is a sectional view of the apparatus in FIG. 6*a* along line 6*f*-6*f* of FIG. 6*d;*
Figure 6F:
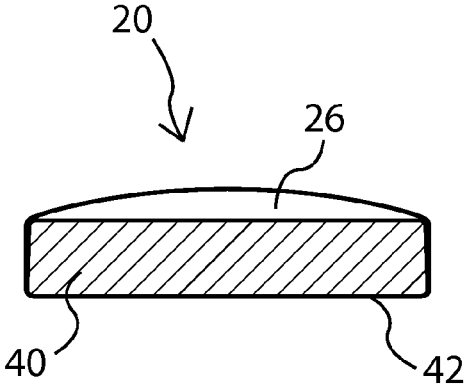
Figure 7A:
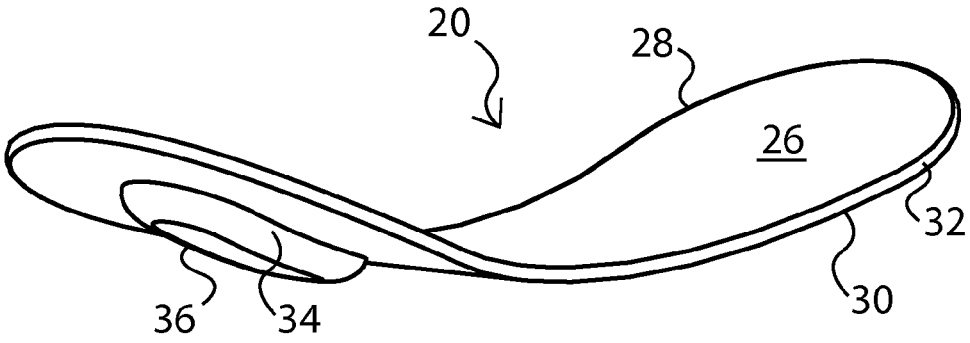
FIG. 7*a* is a sectional view of the apparatus in FIG. 6*a* along line 6*f*-6*f* of FIG. 6*d;*
Figure 7B:
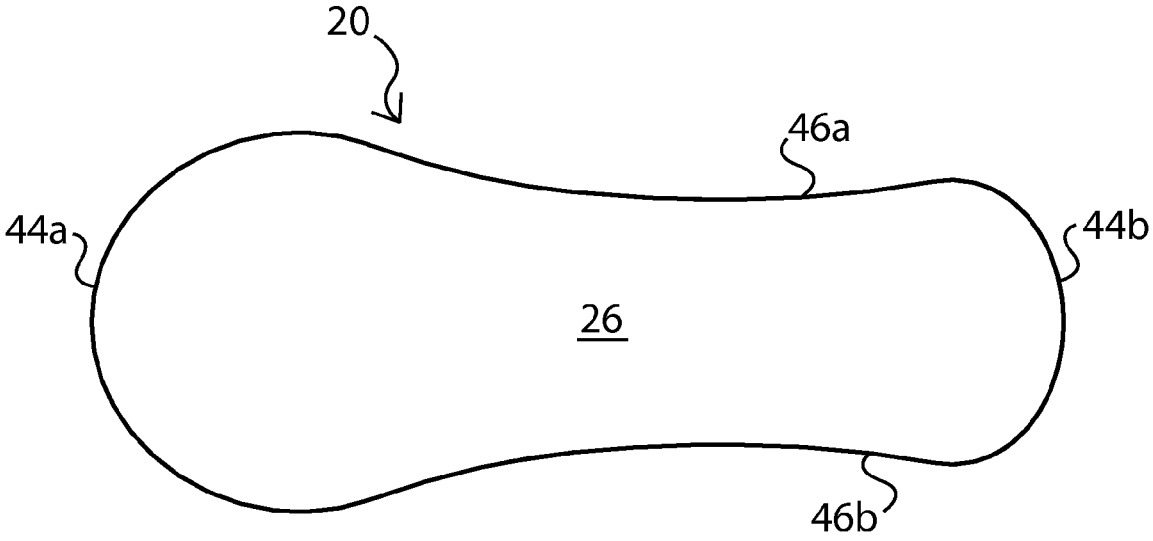
FIG. 7*b* is a top view of the apparatus in FIG. 7*a;*
Figure 7C:
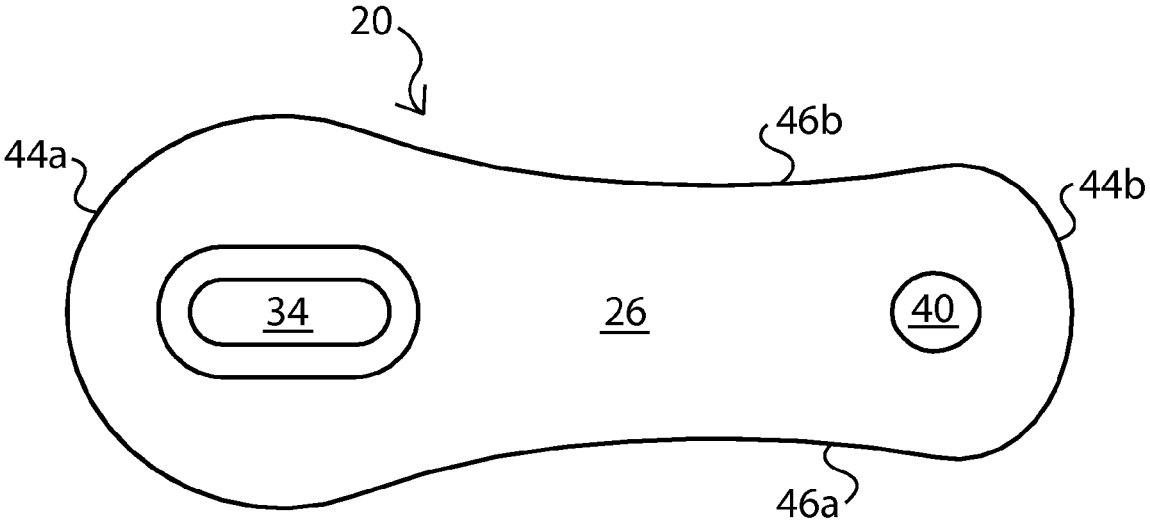
FIG. 7*c* is a bottom view of the apparatus in FIG. 7*a;*
Figure 7D:
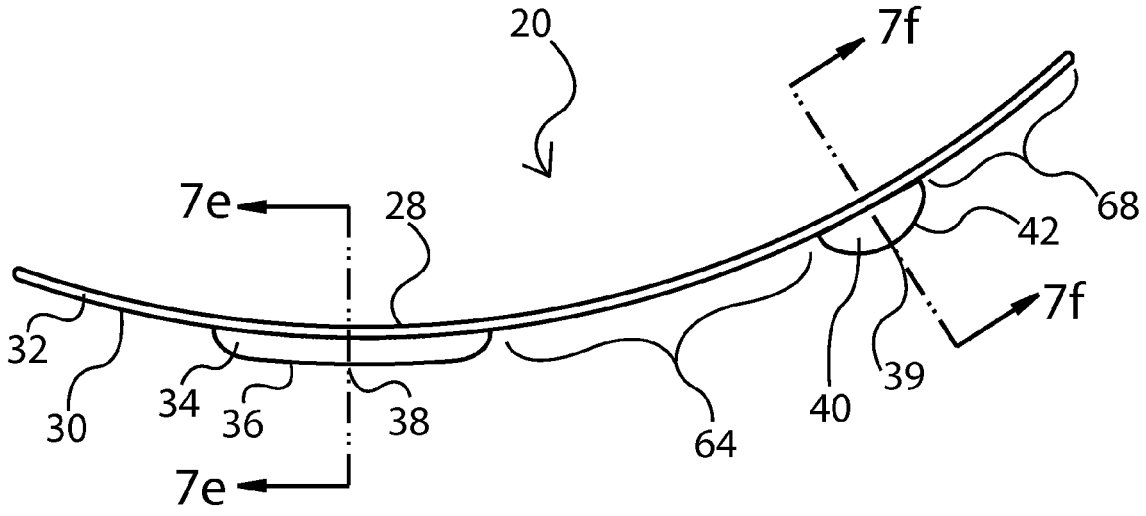
FIG. 7*d* is a side view of the apparatus in FIG. 7*a;*
Figure 7E:
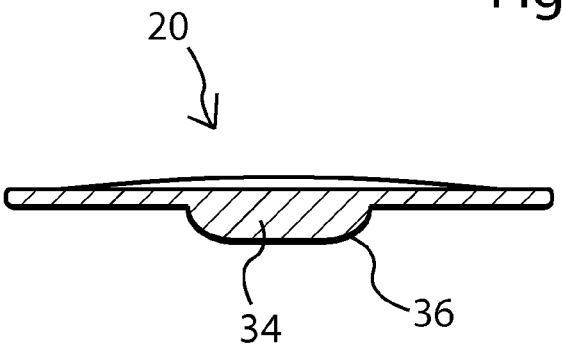
FIG. 7*e* is a sectional view of the apparatus in FIG. 7*a* along line 7*e*-7*e* of FIG. 7*d;*
Figure 7F:
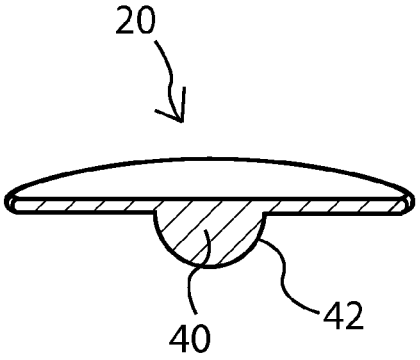
FIG. 7*f* is a sectional view of the apparatus in FIG. 7*a* along line 7*f*-7*f* of FIG. 7*d;*
Figure 7G:
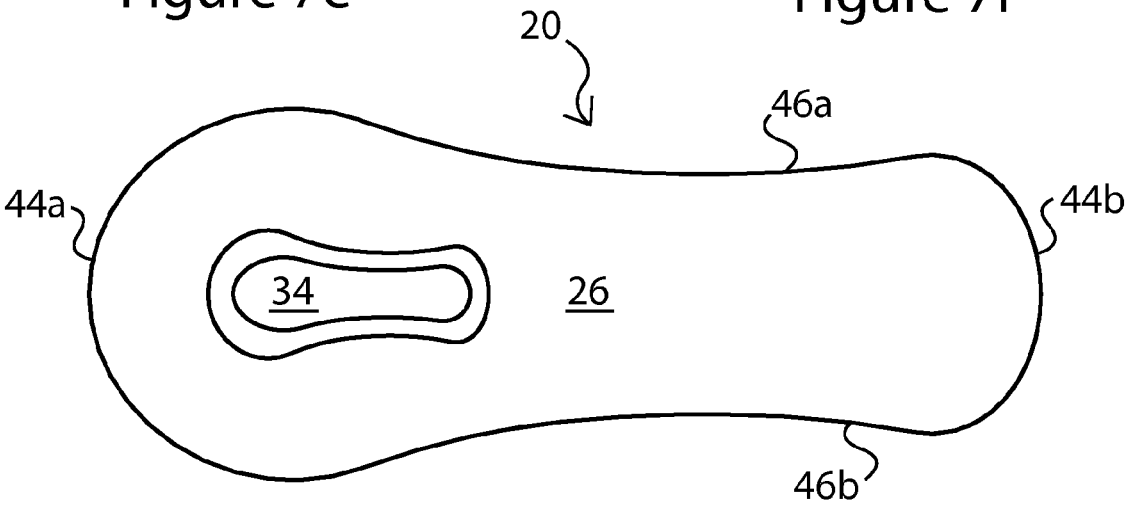
FIG. 7*g* is a bottom view of the apparatus in FIG. 7*a* showing an alternative hub structure.
Figure 8A:
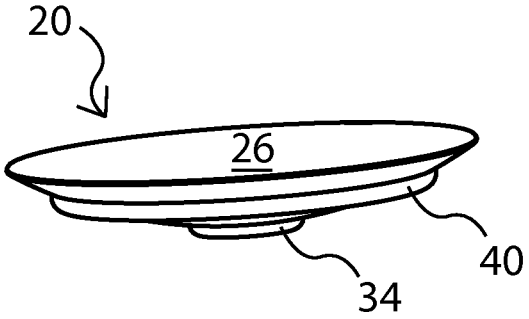
FIG. 8*a* is a perspective view of an embodiment of the apparatus in FIG. 1*a* where the apparatus is bowl-shaped.
Figure 8B:
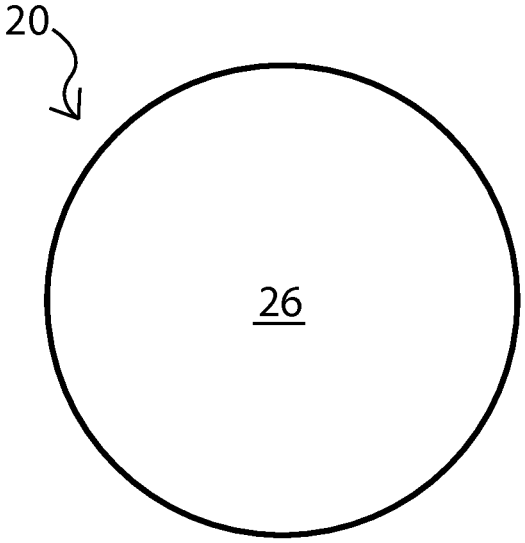
FIG. 8*b* is a top view of the apparatus in FIG. 8*a;*
Figure 8C:
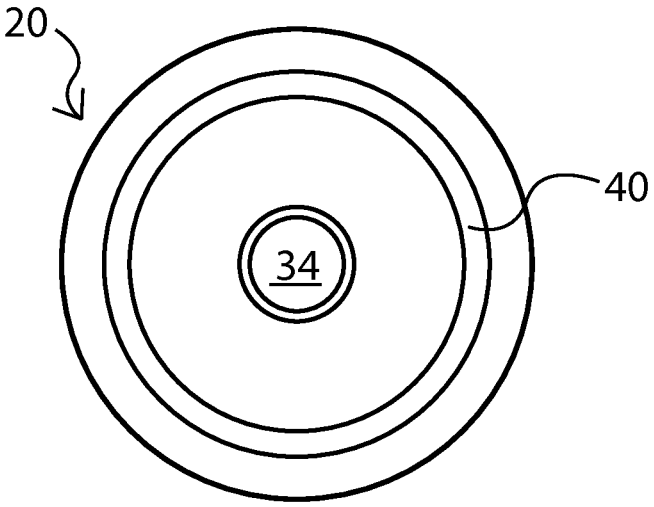
FIG. 8*c* is a bottom view of the apparatus in FIG. 8*a;*
Figure 8D:
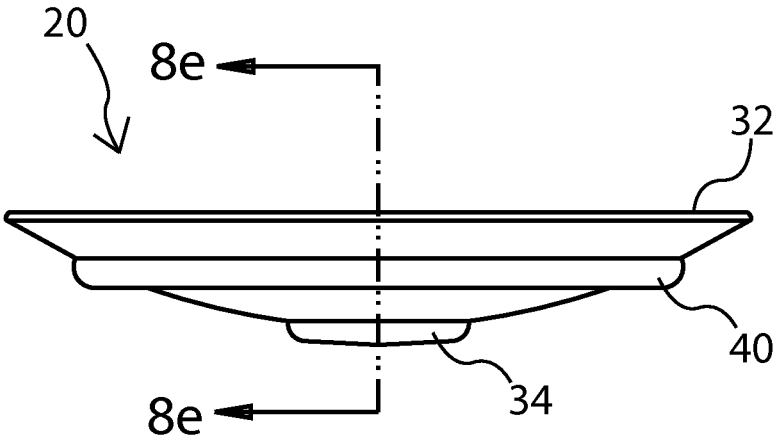
FIG. 8*d* is a side view of the apparatus in FIG. 8*a;*
Figure 8E:
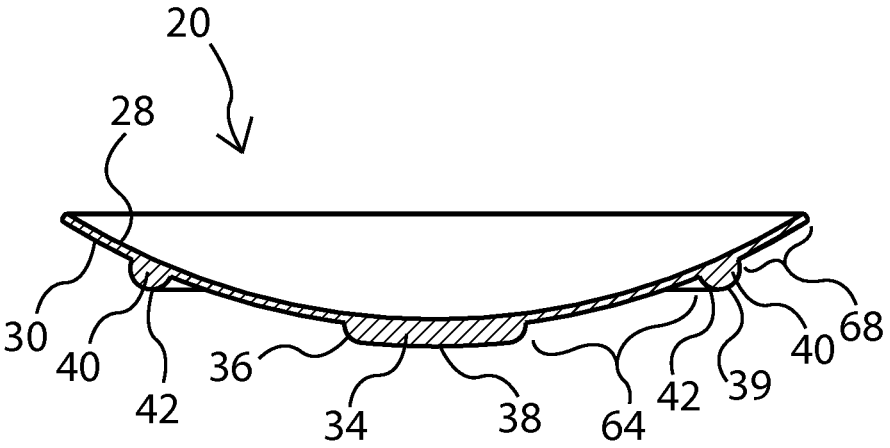
FIG. 8*e* is a sectional view of the apparatus in FIG. 8*a* along line 8*e*-8*e* of FIG. 8*d;*
Figure 9A:
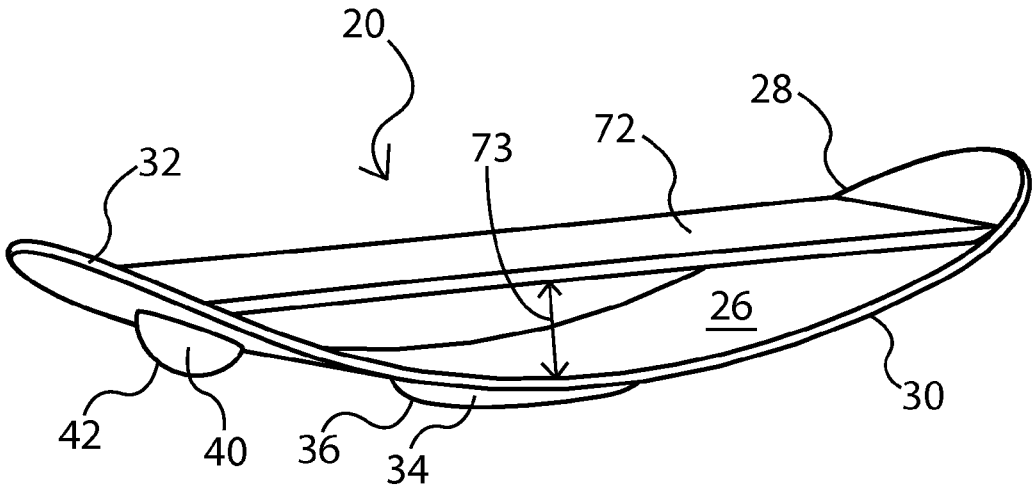
FIG. 9*a* is a perspective view of an embodiment of the apparatus in FIG. 1*a* having a deck member stacked upon the upper surface of the body member.
Figure 9B:
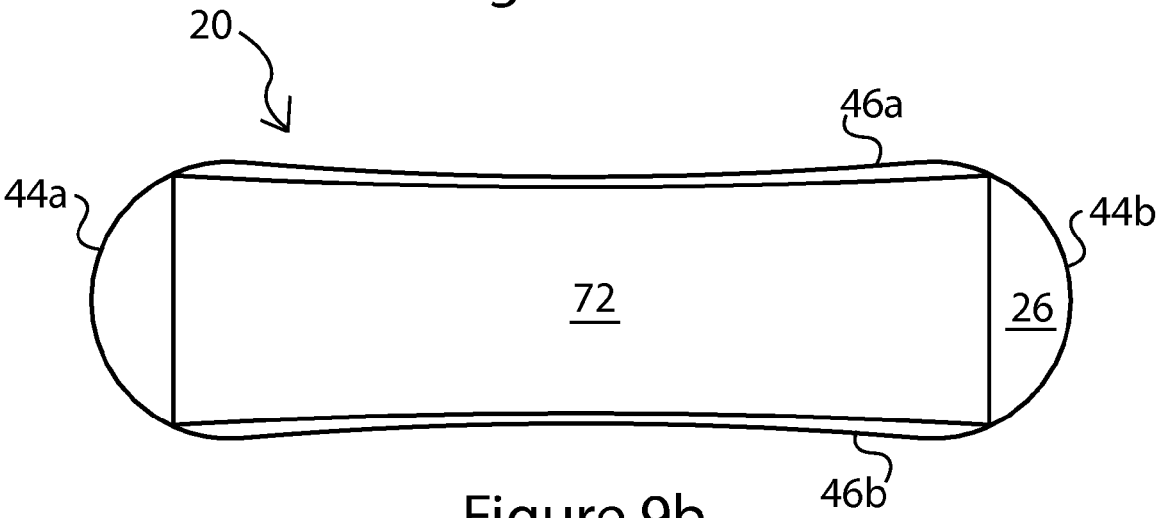
FIG. 9*b* is a top view of the apparatus in FIG. 9*a;*
Figure 9C:
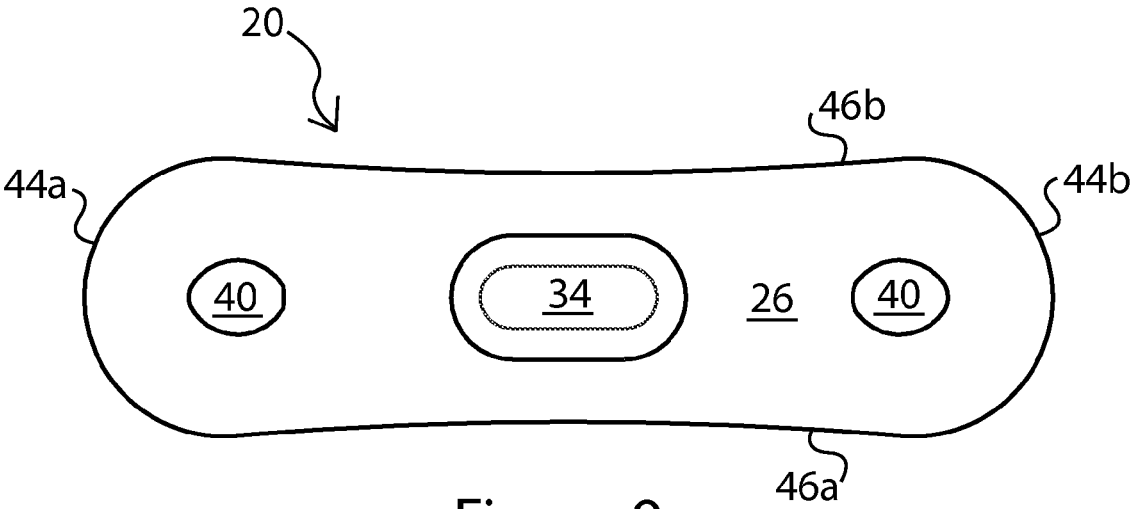
FIG. 9*c* is a bottom view of the apparatus in FIG. 9*a;*
Figure 9D:
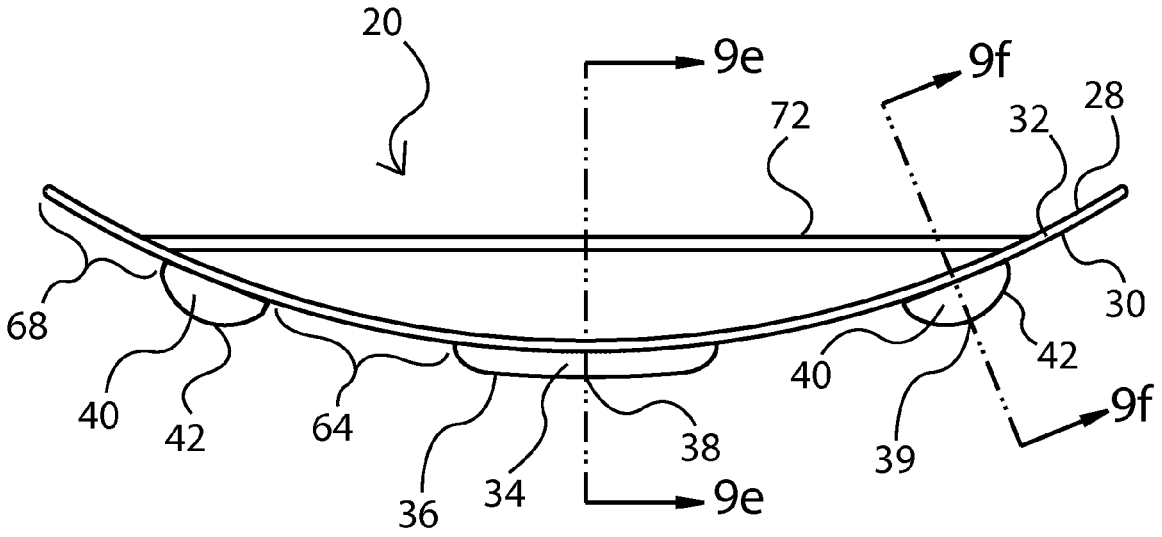
FIG. 9*d* is a side view of the apparatus in FIG. 9*a;*
Figure 9E:
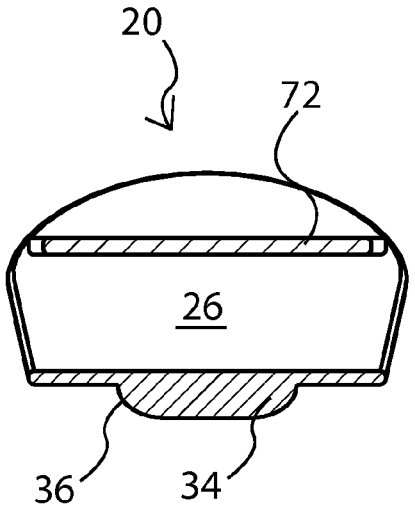
FIG. 9*e* is a sectional view of the apparatus in FIG. 9*a* along line 9*e*-9*e* of FIG. 9*d*.
Figure 9F:
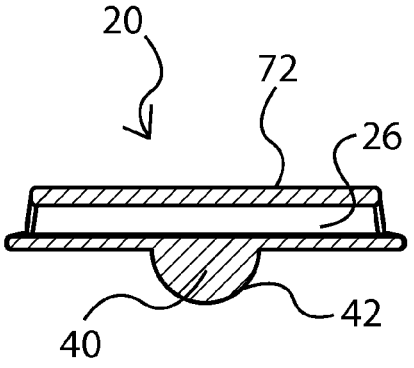
FIG. 9*f* is a sectional view of the apparatus in FIG. 9*a* along line 9*f*-9*f* of FIG. 9*d.*

FIGS. 4*a-f* show an embodiment of apparatus 20 similar to that in FIG. 1*a*, but having both a first body radius of curvature 48 and a second body radius of curvature 49 such that the apparatus is concave and curves away from hub member 34 in both the elongated direction the lateral direction. A key feature in this embodiment is that hub member 34 and nub members 40 are removable as shown in FIGS. 5*a*-5*c*. Hub member 34 and nub members 40 are attached to body member 26 by fasteners 70. Having this removable structure, apparatus 20 can be configured into several embodiments. In one embodiment, the balance board can be configured with just a single hub member and two nub members. In another embodiment, the balance board can be configured with just a single hub member and a single nub member. In yet another embodiment, the balance board can be configured with just a single hub member and no nub members. In still yet another embodiment, both the hub member and nub members could be removed to provide for a more traditional balance board or one where the board can now be used for sliding on snow, sand, water, etc. In this embodiment slots or periodic holes can also be formed in body member 26 so as to allow the user to have the ability to move hub member 34 and nub members 40 to meet the specific way the user would like the balance board to be configured. For example, a taller user may want the hub member and nub members to be further apart.

FIGS. 6*a-f* show an embodiment of apparatus 20 having a curved body member 26 along with a hub member 34 and nub members 40 as in the previous embodiments; however the body member, the huh member and nub members are all created from a single piece of material. Different upper and lower surface radii of curvature create a body member with varying thickness. Hub member 34 and nub members 40 are formed by providing for a first, discontinuity 64 and second discontinuity 68 in lower surface 30. Hub member 34 and nub members 40 are also elongated in the lateral direction.

FIGS. 7*a-f* show an embodiment of apparatus 20 that has the feature of a single hub member 34 and a single nub member 40. Body member 26 is symmetric relative to the first vertical plane that bisects the lateral sides. Although apparatus 20 is shown as wider towards one end than the other, the apparatus could as well be symmetric relative to a second vertical plane that bisects the two opposing ends (44*a*, 44*b*). Key to this embodiment is that hub member 34 is no longer centered relative to body member 26, but rather is more distal to one end.

FIGS. 8*a-e* show an embodiment of apparatus 20 where body member 26 is completely symmetrical and is bowl-shaped. Flub member 34 is centrally located to body member 26. Nub member 40 is structured to be one continuous nub member that circumscribes hub member 34. The user stands with both feet within the bowl having a first balancing surface at hub member 34 and a second balancing surface at nub member 40. This embodiment of apparatus 20 would allow the user to perform exercises and tricks equally in all directions. Alternatively with this embodiment, single nub member 40 could be formed as a plurality of discrete nub members circumscribing hub member 34.

FIGS. 9*a-e* show an embodiment of apparatus 20 where a deck member 72 has been added to the apparatus shown in FIGS. 1*a-f*. Deck member 72 may be integrally formed with body member 26 or the deck member can be a separate removable piece. Deck member 72 may be provided with any of the preceding embodiments. Deck member 72 provides a flat surface on which a user may stand allowing to the user have a flat surface under their feet as opposed to standing on a curved upper surface 28 which is less natural. Apparatus 20 may have a deck gap 73 that exists between deck member 72 and body member 26.

While several embodiments of the invention, together with modifications thereof, have been described in detail herein and illustrated in the accompanying drawings, it will be evident that various further modifications are possible without departing from the scope of the invention. Nothing in the above specification is intended to limit the invention more narrowly than the appended claims. The examples given are intended only to be illustrative rather than exclusive.

What is claimed is:

1. An apparatus for a user to balance upon on a contacting surface, comprising:

a body member bound by an upper surface, a lower surface and a circumscribing edge surface;

a hub member fastened and extending from said lower surface, said hub member having an outer hub surface with a hub apex;

at least one nub member fastened and extending from said lower surface, said at least one nub member having an outer nub surface, said at least one nub member located between said hub member and said circumscribing edge surface, each nub member spaced apart from said hub member; and wherein said outer nub surface is raised relative to the contacting surface when said body member is balanced on said hub apex, wherein said body member is fixed to move with said outer hub surface, wherein said body member has a first vertical plane of symmetry, wherein said body member has a second vertical plane of symmetry, wherein said hub member has a continuously curving hub radius of curvature in said first and second vertical planes of symmetry.

2. An apparatus as recited in claim 1, wherein said body member has an elongated direction defining two opposing ends and two opposing lateral edges.

3. An apparatus as recited in claim 2, where said two opposing ends are up turned away from the contacting surface.

4. An apparatus as recited in claim 1, wherein said body member has a first body radius of curvature, wherein said first body radius of curvature curves away from said hub member.

5. An apparatus as recited in claim 4, wherein said body member has an elongated direction; wherein said first body radius of curvature is along said elongated direction.

6. An apparatus as recited in claim 4, wherein said body member has a second body radius of curvature that curves away from said hub member, said second body radius of curvature perpendicular to said first body radius of curvature.

7. An apparatus as recited in claim 4, further comprising a deck member stacked upon said upper surface with a deck gap there between.

8. An apparatus as recited in claim 7, wherein said deck member is flat.

9. An apparatus as recited in claim 1, wherein said upper surface has a complimentary shape to said lower surface.

10. An apparatus as recited in claim 1, wherein said hub member is centrally located to said body member.

11. An apparatus as recited in claim 1, wherein said hub member is offset from the center of said body member.

12. An apparatus as recited in claim 1, wherein said hub member is removably fastened to said body member.

13. An apparatus as recited in claim 1, wherein said hub member has a location that is movably adjustable along said lower surface.

14. An apparatus as recited in claim 1, wherein said at least one nub member is removably fastened to said body member.

15. An apparatus as recited in claim 1, wherein said at least one nub member has a location that is movably adjustable along said lower surface.

16. An apparatus as recited in claim 1, wherein said outer hub surface has a hub radius of curvature, wherein said outer nub surface has a nub radius of curvature, wherein said hub radius of curvature is different in magnitude than said nub radius of curvature.

17. An apparatus as recited in claim 1, including two or more nub members.

18. An apparatus for a user to balance upon on a contacting surface, comprising:

a body member bound by an upper surface, a lower surface and a circumscribing edge surface, said body member having a first vertical plane of symmetry, said lower surface defining a first lower surface radius of curvature within said first vertical plane of symmetry, said first lower surface radius of curvature curves towards said upper surface, said body member having a second vertical plane of symmetry, said lower surface defines a second lower radius of curvature within said second vertical plane of symmetry, said second lower surface radius of curvature curves towards said upper surface;

a hub member extending from said lower surface; and at least one nub member extending from said lower surface, each said nub member located between said hub member and said circumscribing edge surface.

19. An apparatus as recited in claim 18, wherein said body member has an elongated direction defining two opposing ends and two opposing lateral edges.

20. An apparatus as recited in claim 19, wherein said first vertical plane of symmetry bisects said body member between said two opposing lateral edges.

21. An apparatus as recited in claim 19, wherein said second vertical plane of symmetry bisects said body member between said two opposing ends.

22. An apparatus for a user to balance upon on a contacting surface, comprising:

a body member bound by an upper surface, a lower surface and a circumscribing edge surface, said body member having a hub apex, said lower surface defining a first lower contact radius of curvature in a first vertical plane, said first lower contact radius of curvature curves towards said upper surface;

a first discontinuity in said first lower contact radius of curvature, wherein said lower surface is depressed towards said upper surface between said apex and said circumscribing edge surface; and wherein said lower surface further comprises a second lower contact radius of curvature perpendicular to said first contact radius of curvature, wherein said second lower contact radius of curvature curves towards said upper surface.

23. An apparatus as recited in claim 22, wherein said upper surface defines a first upper radius of curvature in said first vertical plane, said first upper radius of curvature curves away opposite from said lower surface.

24. An apparatus as recited in claim 23, wherein said upper surface further comprises a second upper radius of curvature perpendicular to said first upper radius of curvature, wherein said second upper radius of curvature curves away opposite from said lower surface.

25. An apparatus as recited in claim 22, wherein said lower surface is depressed towards said upper surface between said hub apex and said circumscribing edge surface at two or more locations.

26. An apparatus as recited in claim 22, wherein said body member has an elongated direction that defines two opposing ends and two opposing lateral edges.

27. An apparatus as recited in claim 1, wherein said body member is fixed to move with said outer hub member in all directions.

28. An apparatus as recited in claim 1, wherein said hub member has a single point of contact when contacting the contacting surface.

29. An apparatus as recited in claim 1, wherein said hub member is rigid.

30. An apparatus for a user to balance upon on a contacting surface, comprising:

a body member bound by an upper surface, a lower surface and a circumscribing edge surface, said body member having a first vertical plane of symmetry, said lower surface defining a first lower surface radius of curvature within said first vertical plane of symmetry, said first lower surface radius of curvature concave curves towards said upper surface, further comprising a second vertical plane of symmetry, wherein said lower surface defines a second lower surface radius of curvature within said second vertical plane of symmetry, said second lower surface radius of curvature curves towards said upper surface, and a hub member extending from said lower surface.

31. An apparatus for a user to balance upon on a contacting surface, comprising:

a body member bound by an upper surface, a lower surface and a circumscribing edge surface;

a hub member fastened and extending from said lower surface, said hub member having an outer hub surface with a hub apex;

at least one nub member fastened and extending from said lower surface, said at least one nub member having an outer nub surface, said at least one nub member located between said hub member and said circumscribing edge surface, each nub member spaced apart from said hub member; and wherein said outer nub surface is raised relative to the contacting surface when said body member is balanced on said hub apex, wherein said body member is fixed to move with said outer hub surface, wherein said outer hub surface is a continuously curving nonsymmetrical balance surface.

* * * * *